US007660663B2

(12) United States Patent
Ishikawa et al.

(10) Patent No.: US 7,660,663 B2
(45) Date of Patent: Feb. 9, 2010

(54) TRAFFIC INFORMATION TRANSMITTING APPARATUS, TRANSMITTING METHOD, AND TRANSMITTING PROGRAM

(75) Inventors: Hiroki Ishikawa, Okazaki (JP); Kazutaka Yoshikawa, Okazaki (JP)

(73) Assignee: Aisin AW Co., Ltd., Anjo (JP)

( * ) Notice: Subject to any disclaimer, the term of this patent is extended or adjusted under 35 U.S.C. 154(b) by 319 days.

(21) Appl. No.: 11/093,051

(22) Filed: Mar. 30, 2005

(65) Prior Publication Data

US 2005/0240340 A1 Oct. 27, 2005

(30) Foreign Application Priority Data

Apr. 26, 2004 (JP) ..... 2004-129854

(51) Int. Cl.
*G06G 7/70* (2006.01)
*G06G 7/76* (2006.01)

(52) U.S. Cl. ..... 701/117; 701/118; 701/119; 340/933; 340/934

(58) Field of Classification Search ..... 701/117–119, 701/200; 340/933–934
See application file for complete search history.

(56) References Cited

U.S. PATENT DOCUMENTS 5,459,665 A * 10/1995 Hikita et al. ..... 701/118
5,528,234 A * 6/1996 Mani et al. ..... 340/933
5,539,645 A 7/1996 Mandhyan et al.
5,544,059 A * 8/1996 Hikita et al. ..... 701/117
5,668,717 A * 9/1997 Spall ..... 700/51
5,801,943 A * 9/1998 Nasburg ..... 701/117
6,255,963 B1 7/2001 Heimann et al.
6,259,377 B1 * 7/2001 Noecker et al. ..... 340/933
6,577,946 B2 * 6/2003 Myr ..... 701/117
6,587,778 B2 * 7/2003 Stallard et al. ..... 701/117
2004/0225437 A1 * 11/2004 Endo et al. ..... 701/209
2006/0064233 A1 * 3/2006 Adachi et al. ..... 701/117
2006/0082472 A1 * 4/2006 Adachi et al. ..... 340/995.13

FOREIGN PATENT DOCUMENTS

DE 196 51 143 A1 6/1998
JP 07-021492 * 1/1995
JP 10-283589 * 10/1998
JP A 2003-302224 10/2003

OTHER PUBLICATIONS

Saito et al., Design and Evaluation of Intervehicle Dissemination Protocol for Propagation of Preceding Traffic Information, IEEE Trans. on Intelligent Transportation Systems, vol. 8, No. 3, Sept. 2007, pp. 379-390.*

* cited by examiner

*Primary Examiner*—Cuong H Nguyen
(74) *Attorney, Agent, or Firm*—Oliff & Berridge, PLC

(57) ABSTRACT

A traffic information transmitting apparatus, method, and program store accumulated traffic information including past traffic information and estimate traffic information at a time when a vehicle passes through a predetermined link based on the accumulated traffic information. The apparatus, method, and program determine whether the estimated traffic information is substantially different from traffic information stored in the vehicle. The apparatus, method, and program transmit, when the estimated traffic information and the traffic information stored in the vehicle are substantially different, the substantially different estimated traffic information to the vehicle.

10 Claims, 4 Drawing Sheets

TRAFFIC INFORMATION TRANSMITTING APPARATUS, TRANSMITTING METHOD, AND TRANSMITTING PROGRAM

INCORPORATION BY REFERENCE

The disclosure of Japanese Patent Application No. 2004-129854 filed on Apr. 26, 2004 including the specification, drawings and abstract are incorporated herein by reference in their entirety.

BACKGROUND

1. Related Technical Fields

Related technical fields include traffic information transmitting apparatus and traffic information transmitting methods.

2. Description of Related Art

Conventional vehicle navigation apparatus, such as, for example, described in Japanese Unexamined Patent Application Publication No. 2003-302224, obtain and store various kinds of traffic information necessary for performing a route search from an exclusive information communication system. The conventional vehicle navigation apparatus use the stored information when for searching for a shortest route.

SUMMARY

According to the aforementioned navigation apparatus, when the navigation apparatus has already obtained traffic information data, such as, for example, accumulated statistical data for past traffic information and/or has received traffic data in advance, the same data may be accumulated and/or received more than once. For example, similar to previously obtained traffic information data may be received from an exclusive information communication system. As a result of the redundant data, extra communication time and communication cost may be needed.

Accordingly, it is beneficial to provide a traffic information transmitting apparatus and a traffic information transmitting method that may transmit only traffic information that is substantially different from traffic information which has been previously obtained by the navigation apparatus.

As used herein the term "substantially different" is intended to encompass any difference in the state of the traffic reflected by the transmitted traffic information compared to the previously obtained traffic information. "Substantially different" is not intended to encompass a mere difference in the formatting or type of the traffic information. Similarly "substantially similar" is intended to encompass a similarity in the state of the traffic reflected by the transmitted traffic information compared to the previously obtained traffic information, irrespective of a mere difference in the formatting or type of the traffic information.

Accordingly, various exemplary implementations of the principles described herein provide a traffic information transmitting apparatus including a memory that stores accumulated traffic information including past traffic information and a controller. The controller may estimate traffic information at a time when a vehicle passes through a predetermined link based on the accumulated traffic information and may determine whether the estimated traffic information is substantially different from traffic information stored in the vehicle. The controller may transmit, when the estimated traffic information and the traffic information stored in the vehicle are substantially different, the estimated traffic information to the vehicle as peculiar information.

Various exemplary implementations of the principles described herein provide a traffic information transmitting method. The method may include storing accumulated traffic information including past traffic information and estimating traffic information at a time when a vehicle passes through a predetermined link based on the accumulated traffic information. The method may include determining whether the estimated traffic information is substantially different from traffic information stored in the vehicle, and transmitting, when the estimated traffic information and the traffic information stored in the vehicle are substantially different, the estimated traffic information to the vehicle as peculiar information.

Various exemplary implementations of the principles described herein provide a storage medium sorting a set of program instructions executable on a data processing device and usable to transmit traffic information. The instructions may include instructions for storing accumulated traffic information including past traffic information and instructions for estimating traffic information at a time when a vehicle passes through a predetermined link based on the accumulated traffic information. The instructions may include instructions for determining whether the estimated traffic information is substantially different from traffic information stored in the vehicle, and instructions for transmitting, when the estimated traffic information and the traffic information stored in the vehicle are substantially different, the estimated traffic information to the vehicle as peculiar information.

BRIEF DESCRIPTION OF THE DRAWINGS

Exemplary implementations will now be described with reference to the accompanying drawings, wherein.

DETAILED DESCRIPTION OF EXEMPLARY IMPLEMENTATIONS

Figure 1:
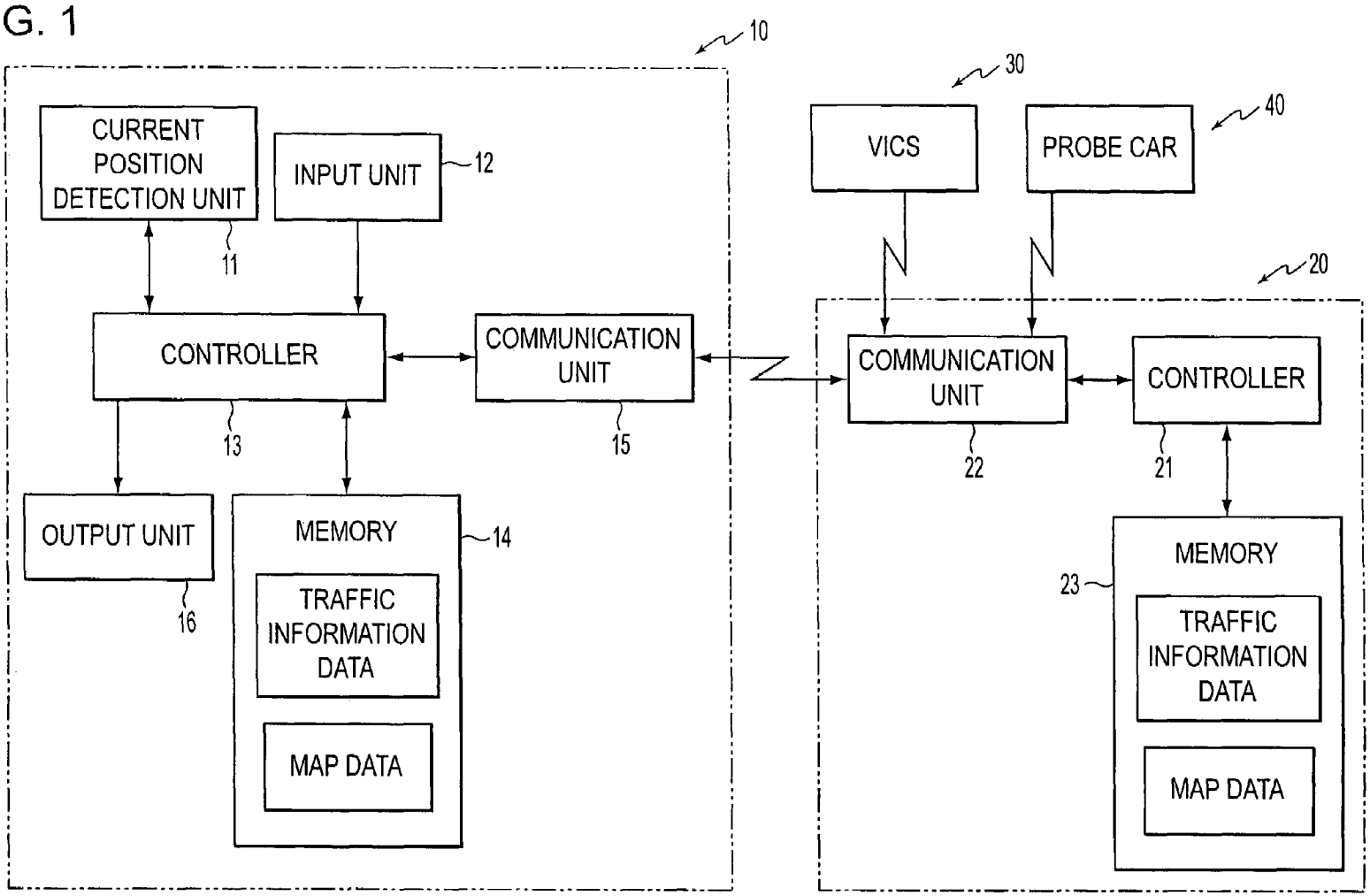
FIG. 1 is a block diagram showing a traffic information transmitting apparatus according to an exemplary implementation of the principles described herein.

FIG. 1 is a diagram showing an exemplary vehicle navigation apparatus. The navigation apparatus 10 may include a current position detection unit 11, such as, for example, a GPS receiver that receives radio waves sent from an artificial satellite of a satellite navigation system (also known as GPS) and detects a current position of the vehicle as well as a present day and time.

In addition, the navigation apparatus 10 may include an input unit 12. The input unit 12 may be a portable remote controller that may send required information to a receiving section (not shown) of a controller 13 (described later). Note that instead of using a remote controller as the input unit 12, for example, a touch panel provided along a display screen in a liquid crystal display panel of an output unit 16 (described later) may be employed as the input unit 12.

Furthermore, the navigation apparatus 10 may be provided with, for example, the controller 13, a memory 14, a communication unit 15, and/or the output unit 16. The controller 13 may include, for example, a CPU, a RAM, and/or a ROM as well as the receiving sections described above connected, for example, by bus lines.

Figure 2:
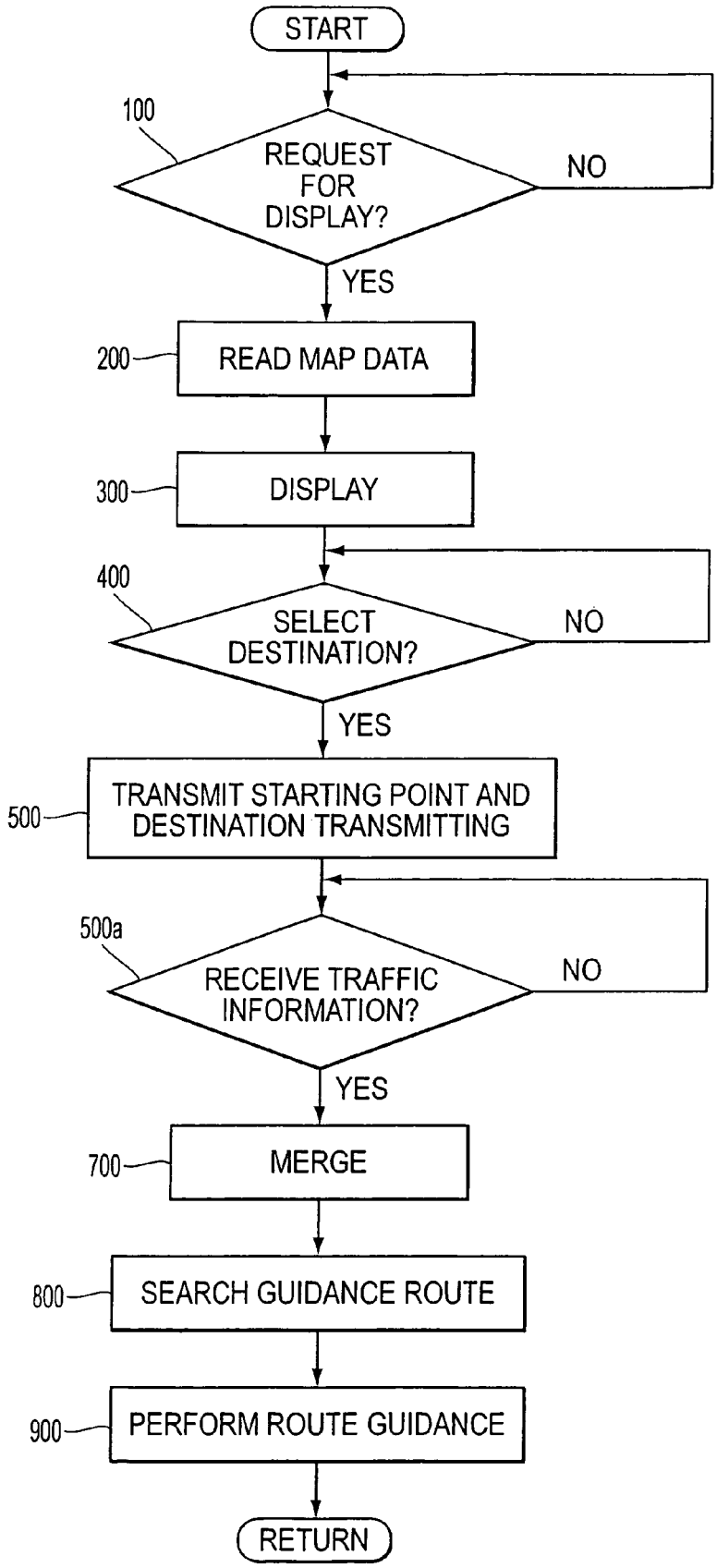
FIG. 2 is a flowchart showing a navigation method according to an exemplary implementation of the principles described herein.

The controller 13 may execute, for example, the exemplary navigation method shown in FIG. 2. Note that, for example, instructions for executing the exemplary method shown in FIG. 2 may be written in advance on a ROM of the controller 13 and executed by the controller 13. During execution of the exemplary navigation method, the controller 30 may provide route guidance for the vehicle and/or may display maps based upon, for example, detection output of the current position detection unit 11, operation of the input unit 12, information stored in the memory 14, information received by the communication unit 15 and/or information from an exclusive information communication system 20 (described later).

The memory 14 may include, for example, a hard disk. Traffic information data and map data may be stored in the memory 14, for example, in the form of a database that is readable by the controller 13. The communication unit 15 may receive road traffic information from the exclusive information communication system 20 and may output the data to the controller 13.

The exclusive information communication system 20, for example, installed in an exclusive information center may execute wireless communication with, for example, the communication unit 15, a road traffic information communication system installed in a road traffic information communication center (hereinafter also referred to as VICS (registered trademark) 30), and/or a probe car 40.

The exclusive information communication system 20 may be provided with, for example, a controller 21, a communication unit 22, and/or a memory 23. The controller 21 may, for example, perform the exemplary of transmitting traffic information shown in FIGS. 3 and 4. The controller 21 may communicate with the communication unit 15 and/or VICS 30 via the communication unit 22. Note that, for example, instructions for executing the exemplary method(s) shown in FIGS. 3 and/or 4 may be written in advance on a ROM of the controller 21 and executed by the controller 21.

The memory 23 may include, for example, a hard disk. The memory 23 may store traffic information data and map data, and may include substantially similar data as the traffic information data in the memory 14 (hereinafter referred to as accumulated data), for example, in the form of a database and readable by the controller 21.

The output unit 16 may include, for example, a display device. Based upon control by the controller 13, the output unit 16 may display information required for the vehicle. Note that the output unit 16 may be, for example, installed in an instrument panel on an anterior wall of the vehicle and may display information on, for example, a display panel such as a liquid crystal panel.

As discussed above, the controller 13 may perform the exemplary method shown in FIG. 2. FIG. 2 shows an exemplary navigation method. As shown in FIG. 2, in step 100 it is determined whether a display is requested, for example, by the input unit 20. If a request for display has not been made, operation returns to step 100.

If a request for display is made, operation continues to step 200 where map data corresponding to the request (hereinafter referred to as "desired map data") is read, for example, out of the memory 14. Then, in step 300, the requested map data is displayed, for example, by output unit 16 on the display panel.

In step 400, it is determined whether a destination has been selected, for example by operation of the input unit 12. If a destination has not been selected, operation returns to step 400. If a destination has been selected, operation continues to step 500. In step 500, a starting point, for example, the current position detected by the current position detection unit 11, and the destination, for example, input by the input unit 12, are transmitted, for example, from the controller 13 to the exclusive information communication system 20 via the communication unit 15.

Next, in step 500*a*, it is determined whether traffic information (for example, peculiar information from the exclusive information communication system 20 described below) is received, for example, by the communication unit 15. If traffic information is not received, operation returns to step 500*a*. If traffic information is received, operation continues to step 700.

In step 700, the traffic information is merged, for example the peculiar area data received by the controller 13 via the communication unit 15 is stored in a database of the memory 14. Next in step 800, a guidance route is searched in consideration of, for example link travel times accumulated in the database of the memory 14. In step 800, guidance along the searched route is started, for example in consideration of traffic congestion prediction.

Figure 3:
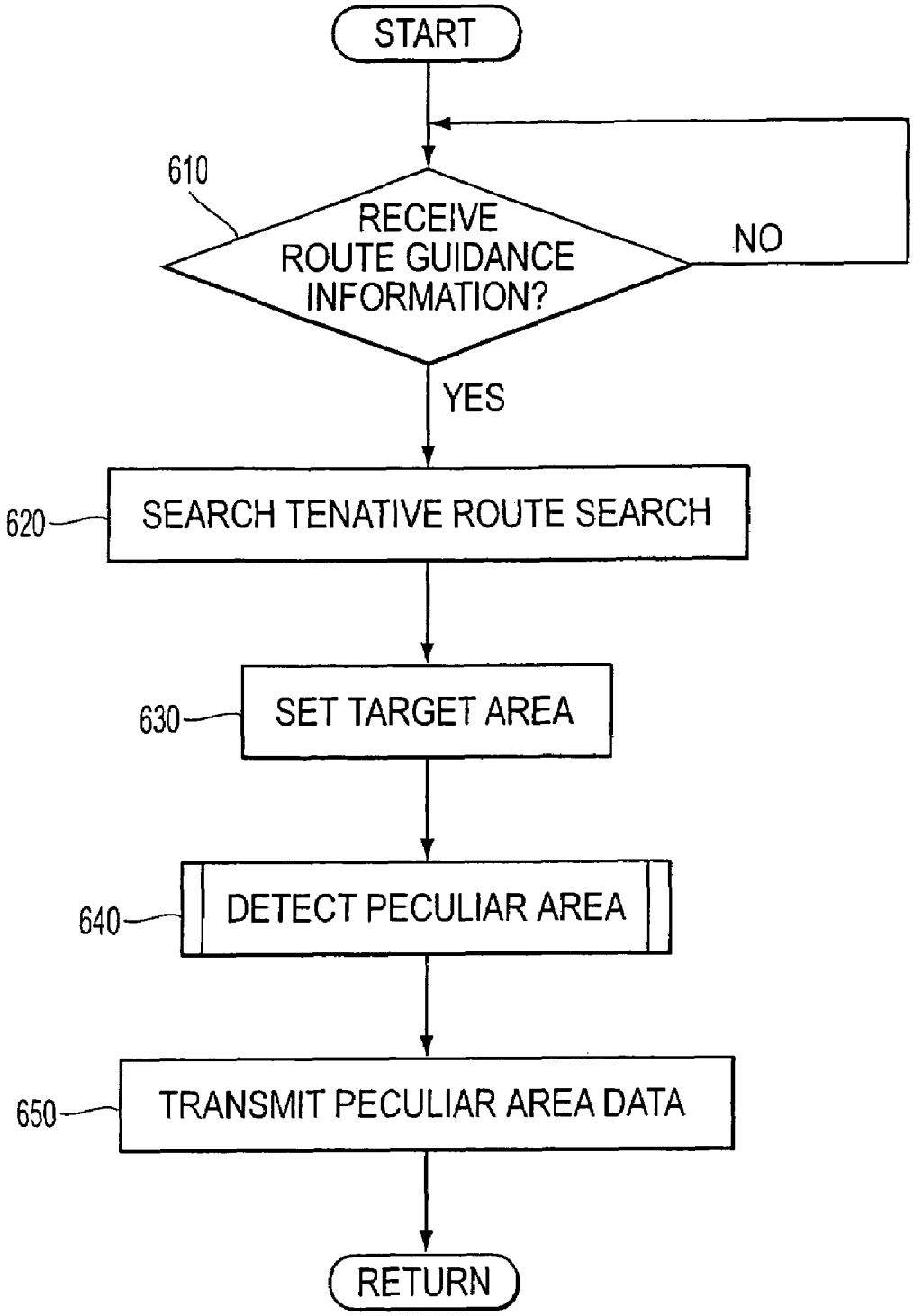
FIG. 3 is a flowchart showing a method of transmitting traffic information according to an exemplary implementation of the principles described herein.
Figure 4:
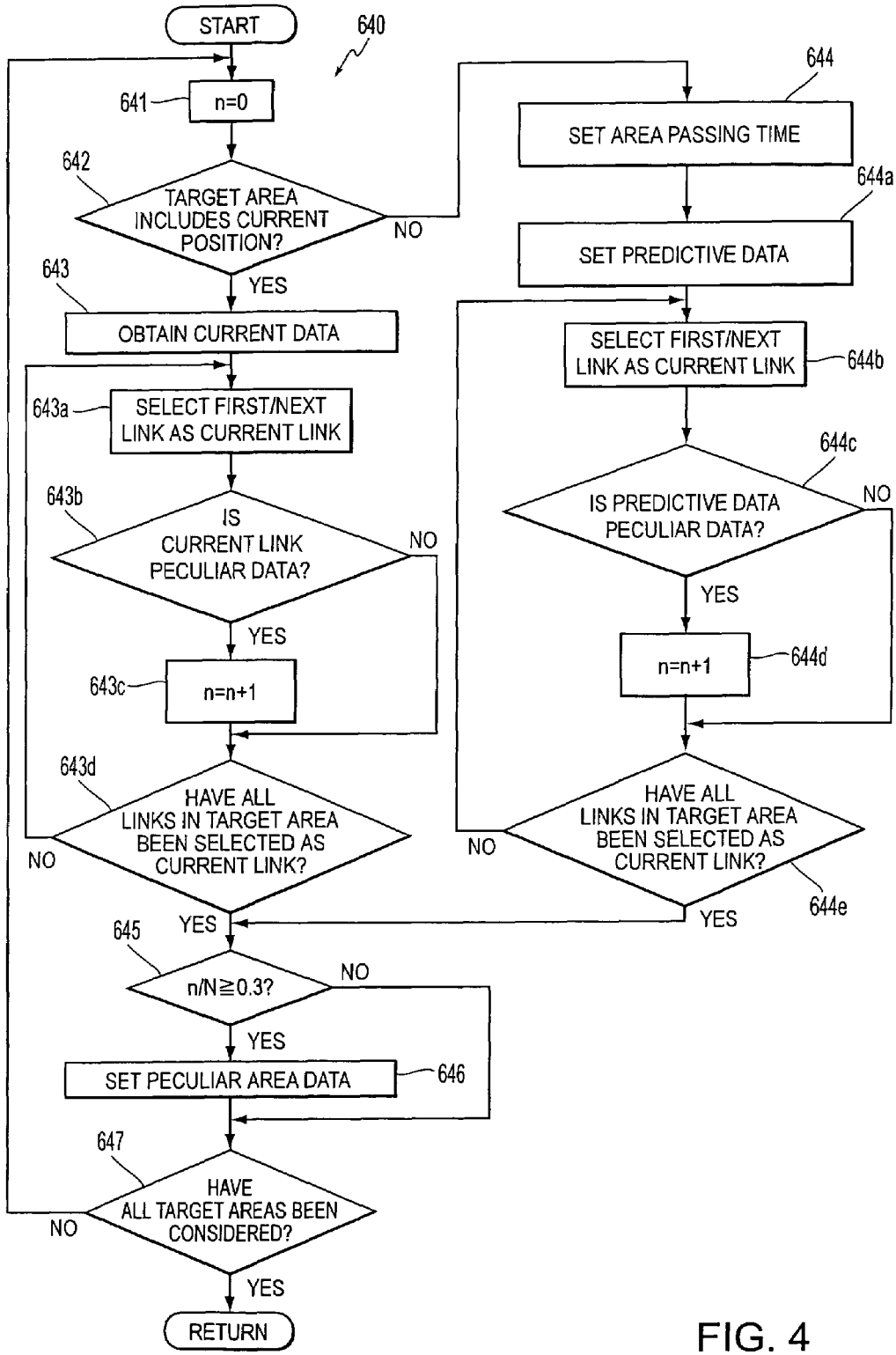
FIG. 4 is a flowchart showing a method of detecting a peculiar area according to an exemplary implementation of the principles described herein.

The traffic information in step 500*a* may be provided, for example, by the controller 21 according to, for example, the exemplary method of transmitting traffic information shown in FIGS. 3 and 4. As shown in FIG. 3, operation of the method begins in step 610.

In step 610, it is determined whether route guidance information is received. For example, the controller 21 of the exclusive information communication system 20 may determined whether a starting point and/or destination is received from, for example, the controller 13 via communication units 15, 22 (e.g., step 500 in FIG. 2). If route guidance information has not been received, operation returns to step 610. If route guidance information is received, operation continues to step 620.

Next, in step 620, a tentative route is searched. For example, a route from the starting point to the destination is searched as a tentative route based on the accumulated data in the memory 23.

In step 630, a target area is set. Fore example, an area including the tentative route searched in step 620 is set as a target area. In this example, "area" is related to the map data stored in the memory 23, for example, an area may be a square region, 10 km on each side within the map data.

In step 640, a peculiar area is detected. The peculiar area may be detected, for example by the exemplary peculiar area detection method shown in FIG. 4. Then, in step 650, the peculiar area data is transmitted as traffic information. For example, the controller 21 may transmit the peculiar area data to controller 13 via communication units 15, 22, for example, for use in step 500*a* of the exemplary method shown in FIG. 2. Operation of the method ends.

FIG. 4 shows an exemplary method for detecting a peculiar area. As shown in FIG. 4, in step 641, a number of peculiar data "n" is set as "n"=0. In step 642, it is determined whether the target area includes the current position. If the target area includes the current position, operation continues to step 643. If the target area does not include the current position, operation jumps to step 644.

As used herein, the term "link" refers to, for example, a road or portion of a road. For example, according to one type of road data, each road may consist of a plurality of componential units called links. Each link may be separated and defined by, for example, an intersection, an intersection having more than three roads, a curve, and/or a point at which the road type changes.

In step 643, current data is obtained. For example, current link travel times for all links within the target area may be obtained from VICS 30 and/or the probe car 40 via the communication unit 22 as current data.

As used herein, a "link travel time" is the time required to travel the length of a corresponding link. A "current link travel time" is the time required to travel the length of a corresponding link at a present time, for example, based on that links characteristics, current traffic, and/or any other factor that may influence the time required to travel the length of a link.

In step 643*a*, the first/next link in the target area is set as the current link. Then, in step 643*b*, it is determined whether the current data for the current link is peculiar data. For example, when a link travel time in the current data (obtained in step 643) is substantially different from a corresponding link travel time in the accumulated data in the memory 23 and/or memory 14, the current data for that link is determined as peculiar data. According to one implementation, a link travel time for a certain link may be considered substantially different if the difference between the link travel time according to the current data and the link travel time according to the accumulated data is equal to or greater than 10% of the link travel time according to the accumulated data.

If the current data for the current link is not peculiar data, operation jumps to step 643*d*. If the current data for the current link is peculiar data, operation continues to step 643*c*. In step 643*c*, the number of peculiar data "n" is updated to "n=n+1." Then, in step 643*d*, it is determined whether all of the links within the target area have been selected as the current link.

If all of the links within the target area have not been selected as the current link, operation returns to step 643*a* where the next link is selected as the current link. If all of the links within the target area have been selected as the current link, operation continues to step 645.

In step 644, an area passing time is set. For example, a time when the vehicle is expected to enter the target area along the tentative route searched in step 620 may be set as an area passing time. In step 644*a*, predictive data is set. For example, link travel times corresponding to the area passing time set in step 644 may be set as predictive data for each link within the target area. It should be appreciated that area passing times may be calculated for each link, or groups of links, within the target area and link travel times corresponding to the area passing times may be set as predictive data for each link.

The predictive data may be calculated based upon two sources of link travel times. Link travel times may be obtained from VICS 30 and/or the probe car 40 via the communication unit 22 relevant to the present time. Link travel times that correspond to the area passing time may be accumulated in the memory 23.

In step 644*b*, the first/next link in the target area is set as the current link. Then, in step 644*c*, it is determined whether the predictive data for the current link is peculiar data. For example, when the predictive data for a link (obtained in step 643) is substantially different from a corresponding link travel time in the accumulated data in the memory 23 and/or memory 14, the predictive data for that link is determined as peculiar data.

If the predictive data for the current link is peculiar data, operation continues to step 644*d*. If the predictive data for the current link is not peculiar data, operation jumps to step 644*e*. In step 644*d*, the number of peculiar data "n" is updated to "n=n+1." Then in step 644*e*, it is determined whether all links in the target data have been selected as the current link.

If all of the links within the target area have not been selected as the current link, operation returns to step 644*b* where the next link is selected as the current link. If all of the links within the target area have been selected as the current link, operation continues to step 645.

In step 645, it is determined whether "n/N" is equal to or greater than a predefined ratio, for example 0.3. "N" denotes the total number of links within the target area. Thus, according to this example, if the number of links having peculiar data is less than 30% of the total number of links within the target area (that is, n/N is less than 0.3), the overall target area is not considered a peculiar area. Similarly, if the number of links having peculiar data is greater than or equal to 30% of the total number of links within the target area (that is, n/N is greater than or equal than 0.3), the overall target area is considered a peculiar area.

If "n/N" is equal to or greater than a predefined ratio, the target area is determined as peculiar and operation proceeds to step 646. If "n/N" is less than a predefined ratio, operation jumps to step 647. In step 646, the target area is set as a peculiar area. Then, in step 647 it is determined whether all target areas have been considered. If all target areas have not been considered, operation returns to step 641 and the method is repeated for a next target area. If all target areas have been considered, operation of the method ends.

As discussed above, according to the exemplary method shown in FIG. 3, in step 650, the controller 21 may send the peculiar area data set in step 646 to the controller 13 via the communication unit 22 and 15.

As a result of the above described exemplary systems and methods, only peculiar data which is not stored in a database of the memory 13 may be transferred to the navigation 10, thus effective data transfer may be executed without transferring unnecessary data which the memory 13 already has obtained. In addition, amount of transferring/receiving data may be reduced, so that it is possible to improve response and reduce communication cost.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

For example, the systems and methods described herein are applicable to vehicles other than a private car, and may be for example, a van, a bus, and/or a train.

In 644, a time when a vehicle driving on a searched tentative route enters into a target area is set as an area passing time based on accumulated data in step 620. However, link travel times may be estimated based on current data and accumulated data for each link on a tentative route in step 620, and it is possible to set area passing times by calculating area entering times based on link travel times on the tentative route.

Specifically, passing times at the beginning or end of a link which reaches the target area may be estimated from the above-mentioned link travel times, a distance may be calculated between the entering point and the beginning or end of the link. An entering time to the target area may be estimated based on a distance ratio.

In step 643*b*, for example, current data may be determined as peculiar data when a current link travel time is within a predetermined range of the average±standard deviation of link travel times in the accumulated data.

In step 643*b*, current data may be determined as peculiar data when a traffic congestion degrees for the current link is different from a corresponding traffic congestion degree in the accumulated data. Note that traffic congestion degrees may be rated on a scale of four (4) levels, for example, in order of traffic congestion degree, "Congested," "Crowded," "Not congested," and "Uncertain." Furthermore, if there is a link without a traffic congestion degree, a vehicle speed may be calculated based on the link travel time and the link length, and the traffic congestion degree for the link may be determined based on the calculated vehicle speed.

In step 644*c*, predictive data may be determined as peculiar data when a current link travel times in the predictive data is within an amount of the average±standard deviation of link travel times in the accumulated data.

In 644*b*, predictive data may be determined as peculiar data when a traffic congestion degrees for the current link in the predictive data is different from a corresponding traffic congestion degree in the accumulated data.

What is claimed is:

1. A traffic information transmitting apparatus for transmitting traffic information to a vehicle, the traffic information transmitting apparatus comprising:

a memory that stores accumulated traffic information including past traffic information and map data; and a controller that is configured to:

receive a current position of the vehicle and a destination;

search for a tentative route from the current position to the destination;

define a plurality of areas within the map data including the tentative route as target areas;

specify entering times when the vehicle enters the target areas;

estimate traffic information for each road within the target areas at the entering times based on the accumulated traffic information;

determine that the each road within the target areas is a peculiar road if the estimated traffic information for the each road is substantially different from past traffic information stored in the vehicle at the entering times;

determine that the target areas are peculiar areas when a ratio of a total number of peculiar roads in each target area to a total number of roads in the target area is equal to or greater than a predetermined ratio; and transmit the estimated traffic information for the each road within the peculiar areas to the vehicle.

2. An information server comprising the traffic information transmitting apparatus of claim 1.

3. The apparatus of claim 1, wherein the entering times are specified by entering times to a part of the tentative route within the target area.

4. The apparatus of claim 1, wherein the controller:

receives current traffic information; and estimates the traffic information at the entering times based on a combination of the received current traffic information and the stored accumulated traffic information.

5. A traffic information transmitting method, comprising:

storing accumulated traffic information including past traffic information and map data in a memory;

receiving a current position of the vehicle and a destination;

searching for a tentative route from the current position to the destination in the map data stored in the memory;

defining a plurality of areas within the map data including the tentative route as target areas;

specifying entering times when the vehicle enters the target areas;

estimating traffic information for each road within the target areas at the entering times based on the accumulated traffic information;

determining that the each road within the target areas is a peculiar road if the estimated traffic information for the each road is substantially different from past traffic information stored in the vehicle at the entering times;

determining that the target areas are peculiar areas when a ratio of a total number of peculiar roads in each target area to a total number of roads in the target area is equal to or greater than a predetermined ratio; and transmitting the estimated traffic information for the each road within the peculiar areas to the vehicle.

6. The method of claim 5, further comprising:

receiving current traffic information; and estimating the traffic information at the entering times based on a combination of the received current traffic information and the stored accumulated traffic information.

7. The method of claim 5, wherein the entering times are specified by entering times to a part of the tentative route within the target area.

8. The method of claim 5, wherein the method is implemented by a controller.

9. A storage medium storing a set of program instructions executable on a data processing device and usable to transmit traffic information, the instructions comprising:

instructions for storing accumulated traffic information including past traffic information and map data;

instructions for receiving a current position of the vehicle and a destination;

instructions for searching for a tentative route from the current position to the destination;

instructions for defining a plurality of areas within the map data including the tentative route as target areas;

instructions for specifying entering times when the vehicle enters the target areas;

instructions for estimating traffic information for each road within the target areas at the entering times based on the accumulated traffic information;

instructions for determining that the each road within the target areas is a peculiar road if the estimated traffic information for the each road is substantially different from past traffic information stored in the vehicle at the entering times;

instructions for determining that the target areas are peculiar areas when a ratio of a total number of peculiar roads in each target area to a total number of roads in the target area is equal to or greater than a predetermined ratio; and instructions for transmitting the estimated traffic information for the each road within the peculiar areas to the vehicle.

10. A computer-readable storage medium storing a computer-executable program usable to transmit traffic information, the program causing a computer to:

store accumulated traffic information including past traffic information and map data;

receive a current position of the vehicle and a destination;

search for a tentative route from the current position to the destination;

define a plurality of areas within the map data including the tentative route as target areas;

specify entering times when the vehicle enters the target areas;

estimate traffic information for each road within the target areas at the entering times based on the accumulated traffic information;

determine that the each road within the target areas is a peculiar road if the estimated traffic information for the each road is substantially different from past traffic information stored in the vehicle at the entering times;

determine that the target areas are peculiar areas when a ratio of a total number of peculiar roads in each target area to a total number of roads in the target area is equal to or greater than a predetermined ratio; and transmit the estimated traffic information for the each road within the peculiar areas to the vehicle.

* * * * *